US007184000B2

(12) United States Patent
Itakura

(10) Patent No.: US 7,184,000 B2
(45) Date of Patent: Feb. 27, 2007

(54) DISPLAY APPARATUS, DISPLAY SYSTEM AND CABLE

(75) Inventor: Naoki Itakura, Ashigarakami-gun (JP)

(73) Assignee: NEC Mitsubishi Electric Visual Systems Corporation, Tokyo (JP)

( * ) Notice: Subject to any disclaimer, the term of this patent is extended or adjusted under 35 U.S.C. 154(b) by 592 days.

(21) Appl. No.: 10/636,160

(22) Filed: Aug. 7, 2003

(65) Prior Publication Data

US 2004/0027515 A1 Feb. 12, 2004

(30) Foreign Application Priority Data

Aug. 9, 2002 (JP) ..... 2002-233354

(51) Int. Cl.
*G09G 5/00* (2006.01)

(52) U.S. Cl. ..... 345/3.1; 345/204

(58) Field of Classification Search ..... 345/3.1, 345/204, 522; 174/34; 348/191, 192; 710/20, 710/21; 725/109, 80; 439/498
See application file for complete search history.

(56) References Cited

U.S. PATENT DOCUMENTS

| | | | | |
|---|---|---|---|---|
| 6,072,465 | A * | 6/2000 | Maeda et al. | 345/156 |
| 6,089,453 | A * | 7/2000 | Kayser et al. | 235/383 |
| 6,092,206 | A * | 7/2000 | Choi | 713/320 |
| 6,804,724 | B2 * | 10/2004 | Shin | 710/2 |
| 6,873,307 | B2 * | 3/2005 | Nitta et al. | 345/3.1 |
| 2002/0060676 | A1 | 5/2002 | Kim | |

FOREIGN PATENT DOCUMENTS

| | | |
|---|---|---|
| EP | 1 111 572 A2 | 6/2001 |
| JP | 06-206359 | 7/1994 |
| JP | 11-161460 | 6/1999 |
| JP | 2000-222083 | 8/2000 |
| JP | 2001-125693 | 5/2001 |
| JP | 2001-166761 | 6/2001 |
| JP | 2001-175230 | 6/2001 |
| JP | 2001-346202 | 12/2001 |
| JP | 2003-029729 | 1/2003 |
| JP | 2003-241724 | 8/2003 |

* cited by examiner

*Primary Examiner*—Richard Hjerpe
*Assistant Examiner*—Abbas I. Abdulselam
(74) *Attorney, Agent, or Firm*—Scully, Scott, Murphy & Presser, P.C.

(57) ABSTRACT

In order to automatically distinguish a type of cable connected to a display apparatus, and transmit appropriate specification information to a host, when a host 10 and a display apparatus 100 are connected via a DVI-D to DVI-D cable 14 for digital signal, a DDC 5V from the host is applied to an emitter of a detection transistor 19, and a lower voltage due to a resistor 17 is applied to its base so that the detection transistor turns on. A collector voltage thus becomes an H level so that a multiplexer 21 is switched to the side of a non-volatile memory 23 in which a digital EDID is stored. When they are connected via a D-Sub to DVI-I conversion cable 15 for analog signal, a DDC 5V terminal and an HPD terminal of the cable are short circuited, so the detection transistor turns off, the collector voltage becomes an L, and the multiplexer is switched to the non-volatile memory side in which an analog EDID is stored.

12 Claims, 6 Drawing Sheets

DISPLAY APPARATUS, DISPLAY SYSTEM AND CABLE

BACKGROUND OF THE INVENTION

1. Field of the Invention

The present invention relates to an ideal display system, used in a display system where a host that outputs a digital video signal, or a host that outputs an analog video signal are connected to a display apparatus via respective specialized cables, and to a display apparatus and to a cable for connecting the display apparatus to a computer.

2. Description of the Related Art

Heretofore there is known a display system where, a host such as a computer graphics card that outputs RGB (red green blue) analog signals as video signals, and a similar host that outputs digital TMDS (Transition Minimized Differential Signaling) signals as video signals, are selectively connected via their respective specialized cables to a display apparatus, so as to display the video signals from each of the hosts.

Operating systems of current computers serving as the aforementioned hosts further comprise a plug and play function such that, when the display apparatus is connected to a host, that host reads the specification information of the display apparatus and selects the appropriate driver software corresponding to that specification information, and automatically carries out setting inside the host so as to perform the appropriate display.

The specification information that a plug and play supported display apparatus gives to the host side is known as EDID (Extended Display Identification Data). This includes information such as the resolution, synchronization signal frequency and serial number of the display apparatus, and is also data for the interface types with which the display apparatus is compatible, that is data which differs depending on whether the video signal is the aforementioned analog RGB (red green blue) signal or the digital TMDS signal. This EDID is transmitted to the host via an SCL clock line and an SDA data line called a DDC (Display Data Channel) communication line, inside the connection cable.

The aforementioned interface type has mainly been an analog interface type employing a D-sub connector (15-pin D-shell Display Connector) that handles analog signal. However DVI, advocated by the American VESA (Video Electronics Standards Association) as the standard specification for interfaces which can handle both analog and digital signals, is also steadily becoming popular. Within DVI there is DVI-I, which can accommodate both digital and analog signals, and DVI-D, which only accommodates digital TMDS signals, and care is taken to ensure that a DVI-I connector plug cannot be inserted into the digital DVI-D connector receptacle on the display apparatus side. However, despite the popularization of DVI, a large number of hosts carrying D-sub analog interface remains.

Because of this, display apparatuses are being produced where the display apparatus is equipped with a DVI-I receptacle able to accommodate both digital and analog signals, and if the host has a D-Sub connector, a D-Sub to DVI-I conversion cable is employed, and if the host has a DVI-D connector, it is connected employing a connection cable with both ends DVI-D.

In a display apparatus equipped with a DVI-I receptacle able to accommodate both analog and digital video signals, in order to realize a plug and play function it is necessary to have a total of two (nonvolatile memories), namely a first nonvolatile memory containing EDID for analog and a second nonvolatile memory containing EDID for digital. However, with the D-Sub connector of the analog interface, and even with a DVI-I connector, the DDC communication line that reads the EDID is only equipped with one line each for SCL and SDA, in other words, enough for only one channel. Therefore, in a display apparatus equipped with a DVI-I receptacle able to accommodate both analog and digital video signals, it is necessary to have a configuration that connects each of the nonvolatile memories for analog and for digital, and the SCL and SDA lines via a multiplexer, and selectively uses a DDC communication line of one channel by switching the multiplexer, to thereby transmits the EDID data to the host.

Moreover, it is necessary to operate the switching circuit made up of this plurality of nonvolatile memories and the multiplexer through a power source (DDC 5V) which the host side supplies to the display apparatus through a connection cable. This is in order to realize the plug and play function, even if the user starts the host first, before the display apparatus.

However there are cases in which, when the switching of the multiplexer is not appropriate, the EDID for digital is sent while connected to an analog interface, or conversely the EDID for analog is sent while connected to a digital interface. If the host receives this kind of incorrect EDID the appropriate driver software cannot be selected, and due to this the screen will not display an image at all, or alternatively does not give the correct display.

In order that the multiplexer can be switched by a voltage of DDC 5V only, then heretofore a method has been proposed where, as shown in FIG. 5, the user selects beforehand which EDID is to be read by means of a control key 61 of the display apparatus, and this selection result is stored in a third nonvolatile memory 52, and the multiplexer 21 is then switched based on this information. In the drawing, reference numeral 22 denotes a nonvolatile memory in which the analog EDID is stored, reference numeral 23 denotes a nonvolatile memory in which the digital EDID is stored and reference numeral 16 denotes a DVI-I receptacle 16.

Moreover, FIG. 6 is a drawing showing the configuration of a display system disclosed in Japanese Unexamined Patent Application, First Publication No. 2001-175230. This method disconnects or grounds (disconnected in the figure) the DDC 5V of the D-Sub to DVI-I conversion cable 56 connected to the host 11 for analog signals, and automatically switches the multiplexer 21 based on the voltage of the DDC 5V. A rectifier circuit 54 for analog synchronization signals is added, and when the D-Sub to DVI-I conversion cable 56 is connected, power to the nonvolatile memory 22 which stores the analog EDID is turned on by the output from this rectifier circuit 54 as a power supply, to switch the multiplexer 21 to the analog EDID side. Reference numeral 10 denotes the host for the digital signal, reference numeral 14 denotes the DVI-D to DVI-D cable for connecting the DVI-I receptacle 16 and the host 10, and the DDC 5V is not disconnected or not grounded.

However, in the configuration of FIG. 5, the user is required to operate the settings using the control key 61 on the display. Moreover, if the settings are not correct, not only is the correct EDID not sent, but it is necessary to correct the third nonvolatile memory 52, requiring even further complex operations.

Moreover, in the method of FIG. 6, since the user does not perform the setting, the operation is not complex. However in a system in which the host side first reads the EDID and then outputs the video signal, the wrong EDID may be sent via the multiplexer when switched in a situation where an output from the rectifier circuit 54 has not been obtained. Furthermore in the method of FIG. 6, a rectifier circuit for the synchronized signal is necessary, and there is a problem in that the synchronized waveform becomes disordered or dulled due to the substrate wiring to the diode, or the capacitance between the terminals, thus affecting the image quality. Especially with flat panel displays, represented by liquid crystal displays, it is necessary to perform an AD conversion on the analog video signal, and the sampling clock for the A/D conversion is generated with the horizontal synchronization signal as a reference. Consequently there is a problem in that the disordering or dulling of the synchronized waveform amplifies the phase shift of the sampling clock, so that the change in the sampling point of the video signal becomes visible as the brightness changes, and so-called phase noise worsens.

In addition, according to the method of FIG. 6, since the DDC 5V of the D-Sub to DVI-I conversion cable 56 is disconnected, then when using this cable with a display apparatus that does not have the rectifier circuit 54, there is a problem in that the plug and play function cannot be realized, that is to say, the generality of the cable is low.

SUMMARY OF THE INVENTION

The present invention addresses the aforementioned problems, with an object of providing a display apparatus that does not require troublesome setting on a display apparatus, and which can selectively output the correct EDID by means of a cable of high generality, and a display system and a cable.

To achieve the above objects, the display apparatus of the present invention comprises: a storage device that stores a plurality of specification information for the display apparatus; a connection device capable of selectively connecting a plurality of types of cable, and which has a first terminal for connection to a power supply terminal of said cable and a second terminal for connection to a power supply detection terminal of said cable; a resistor connected between said first and second terminals; a distinguishing device which distinguishes the type of the cable connected to said connection device by detecting a potential difference due to said resistor; a selection device that selects one of said specification information from said storage device based on the distinction result of said distinguishing device; and a transmission device that transmits the specification information selected by said selection device via said connection device and cable to a computer.

Furthermore the display system of the present invention comprises: a display apparatus provided with: a storage device that stores a plurality of specification information for the display apparatus; a connection device capable of selectively connecting a plurality of types of cable, and which has a first terminal for connection to a power supply terminal of said cable and a second terminal for connection to a power supply detection terminal of said cable; a resistor connected between said first and second terminals; a distinguishing device which distinguishes the type of the cable connected to said connection device by detecting a potential difference due to said resistor; a selection device that selects one of said specification information from said storage device based on the distinction result of said distinguishing device; and a transmission device that transmits the specification information selected by said selection device via said connection device and cable to a computer; one of said plurality of types of cable for connection to said connection device; and a computer provided with: a connection device for connection to said display apparatus via said cable; and a transmission device which transmits a video signal to said display apparatus based on said specification information sent from said display apparatus.

Furthermore, the cable of the present invention has; a first connector at one end that connects to a computer, and a second connector at the other end that connects to a display apparatus, and between said first and second terminals, there is provided a power supply line from said computer, a specification information transmission line from said display apparatus, and an analog video signal transmission line from said computer, and said second connector is provided with a power supply detection terminal short circuited to the power supply line.

According to the above configuration, by the user simply connecting the cable, the type of cable can be automatically distinguished on the display apparatus side, and based on the distinction result, the appropriate specification information selected and transmitted.

According to the present invention, with the simple operation of the user connecting the cable, before the host transmits the video signal, the display apparatus can automatically distinguish the type of cable, carry out switching of the selection device for the multiplexer or the like corresponding to the distinction, and select the appropriate specification information and transmit this to the host. Consequently, having received the specification information the host selects the appropriate software and carries out internal setting so that the appropriate video signal for digital or analog can be sent to the display apparatus, and the plug and play function can be realized.

Also, since circuits are not added for the image signal or synchronized signal, there is no effect on the picture quality, and the generality of the cable can be made even higher.

DETAILED DESCRIPTION OF THE INVENTION

Embodiments of the present invention are described with reference to the drawings.

Figure 1:
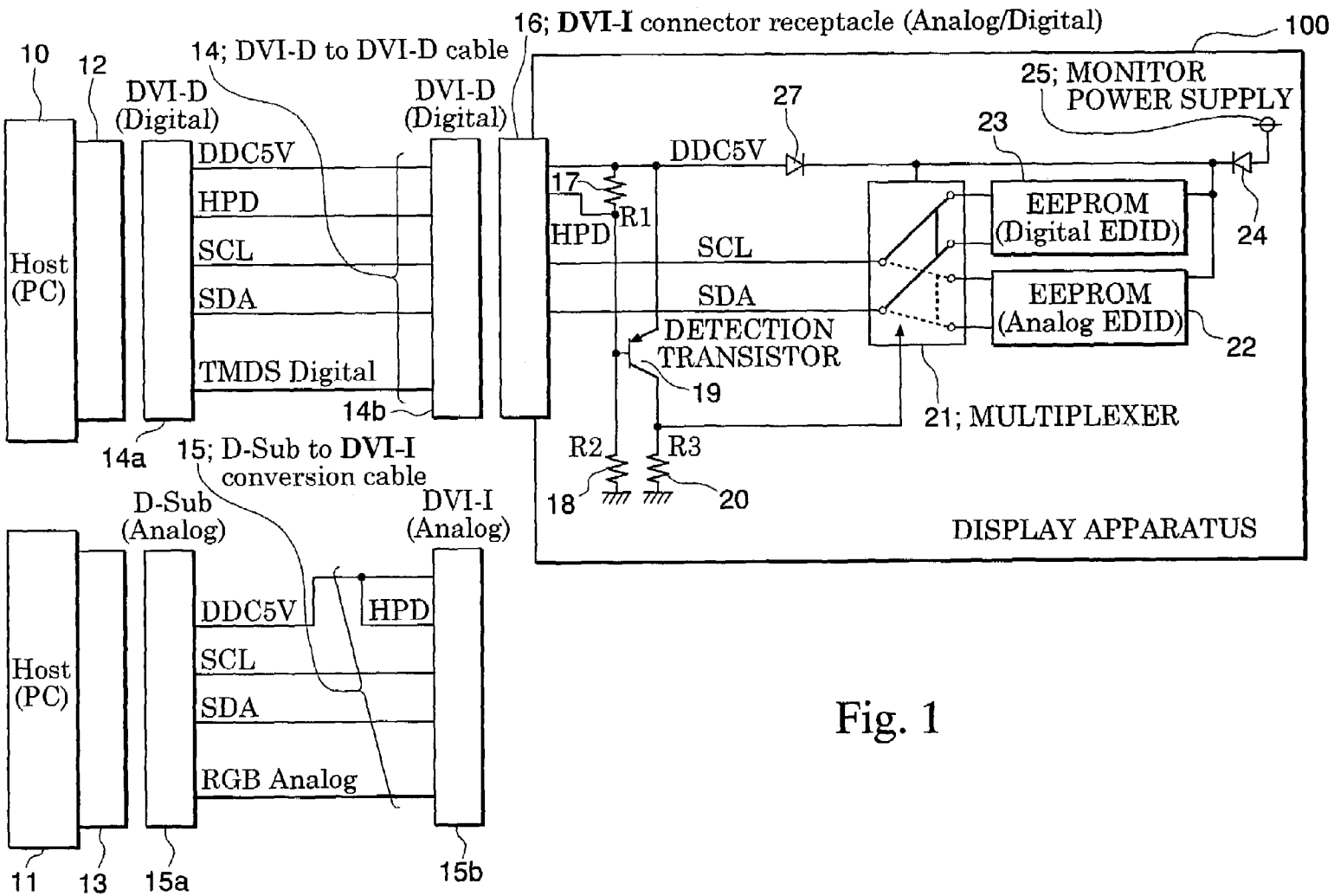
FIG. 1 is a block diagram showing a display system according to a first embodiment of the present invention.

FIG. 1 is a block diagram showing a display system according to a first embodiment of the present invention.

In FIG. 1, reference symbol 100 denotes a display apparatus, which has a DVI-I receptacle 16 as a connection device for both analog and digital video signals. Reference symbol 10 denotes a host that outputs a digital TMDS signal, and has a DVI-D connector 12. Reference symbol 11 denotes a host that outputs an analog RGB signal, and has a D-sub connector 13.

Reference symbol 14 denotes a DVI-D to DVI-D cable for digital signals which connects the display apparatus 100 and the host 10. One end has a DVI-D connector **14*a*** connected to the DVI-D connector 12, and the other end has a DVI-D connector 14*b* connected to the DVI-I receptacle 16. Furthermore it has a DDC 5V line, an HPD (Hot Plug Detect) terminal, an SCL line and an SDA line for communication, and a digital TMDS signal line. The DDC 5V line and the HPD terminal are not short-circuited. The HPD terminal is a power supply detection terminal. This terminal is for confirming that the connectors are connected when the DVI-D to DVI-D cable 14 is connected to the DVI-I receptacle 16, described later, provided on the display apparatus 100, by detecting the power-supply voltage supplied from the DDC 5V line via a resistor 17, described later, and passing this on to the host 10.

Reference symbol 15 denotes a D-Sub to DVI-I conversion cable 15 for analog signals which connects the display apparatus 100 and the host 11. One end has a D-Sub connector 15*a* connected to the D-sub connector 13, and the other end has a DVI-I connector 15*b* connected to the DVI-I receptacle 16. Furthermore it has a DDC 5V line, an SCL line and an SDA line for EDID transmission, and an analog RGB signal line. The HPD terminal is short-circuited to the DDC 5V line on the DVI-I connector 15*b* side.

In the display apparatus 100, analog EDID is stored in a nonvolatile memory (EEPROM) 22 and digital EDID is stored in a nonvolatile memory 23. As mentioned above, EDID is the specification information of the display apparatus 100. One of either the digital EDID or the analog EDID of the aforementioned nonvolatile memories 22 and 23 is selected by a multiplexer 21 serving as a selection device, and is transmitted to the host 10 or the host 11 through the DVI-D to DVI-D cable 14 or the D-Sub to DVI-I conversion cable 15, via the SCL terminal and the SDA terminal of the DVI-I receptacle 16.

Power-supply voltage from a monitor power supply 25 is supplied to the nonvolatile memories 22 and 23, and to the multiplexer 21, and power-supply voltage is also supplied from the DDC 5V terminal. In order to prevent the electric currents supplied by the two power supplies from discharging to each other, diodes 24 and 27 are connected in opposite directions to each other.

The resistor 17 (R1) is connected between the DDC 5V terminal and the HPD terminal of the DVI-I receptacle 16. As a result, a potential difference is generated between the DDC 5V terminal and the HPD terminal. A resistor 18 is connected in series to the resistor 17 and is grounded. The connection nodes of the resistors 17 and 18 are connected to the base of a detection transistor 19 serving as a distinguishing device. The collector of the detection transistor 19 is grounded through the resistor 20 (R3), and the emitter is connected to the DDC 5V terminal. The collector voltage of this detection transistor 19 acts as a switching signal, and by making this an H level or an L level, the multiplexer 21 is switched.

It is assumed that this display apparatus 100 is equipped with a known image processing circuit (omitted in the figure) which has a function of displaying analog and digital video signals transmitted from the host 10 or the host 11.

Next, the operation of the aforementioned configuration is described.

First, in a condition where a cable is not connected to the DVI-I receptacle 16 of the display apparatus 100, the power-supply voltage from the monitor power supply 25 is supplied to the nonvolatile memories 22 and 23 and the multiplexer 21 via the diode 24. This voltage is blocked by the diode 27, and so a voltage does not appear at the DDC 5V terminal and the HPD terminal. Consequently, the detection transistor 19 does not operate, and its collector voltage, which acts as a switching signal, becomes an L level. As a result, the multiplexer 21 is switched to the side of the nonvolatile memory 22 in which the analog EDID is stored.

Next, it is assumed that the host 10 and the display apparatus 100 are connected via the DVI-D to DVI-D cable 14 for digital signal. In this case, the DDC 5V terminal and the HPD terminal are not short-circuited. Therefore, when DDC 5V is supplied from the host 10, this voltage is applied to the emitter of the detection transistor 19, and a 0.7V lower voltage due to the resistor 17 is applied to its base, so that the detection transistor 19 turns on. Accordingly, current flows into the resistor 20, and the collector voltage becomes H level, so that the multiplexer 21 is switched to the side of the nonvolatile memory 23 in which the digital EDID is stored.

When the DVI-D to DVI-D cable 14 is used, the circuit of the host 10 is connected through the HPD terminal. However, with the configuration shown in FIG. 1, even if the electric current flows from the display apparatus 100 side to the host 10 side, the ON status of the detection transistor 19 is unchanged, so there is no change in the state of the multiplexer 21.

Next, it is assumed that that the host 11 and the display apparatus 100 are connected via the D-Sub to DVI-I conversion cable 15 for analog signal. In this case, the DDC 5V terminal and the HPD terminal are short-circuited, and hence the potential difference between the base and the emitter of the detection transistor 19 disappears. Therefore, base electric current does not flow and the detection transistor 19 turns off, so that the collector voltage becomes L level. As a result, the multiplexer 21 is switched to the nonvolatile memory 22 side.

Even in the case where the monitor power supply 25 is not turned on, as long as the power-supply voltage of the DDC 5V is supplied from the host 11, the multiplexer 21 and the nonvolatile memory 22 and 23 still operate, and consequently, the aforementioned series of operations can be carried out.

According to this embodiment, a user needs only connect either the host 10 for digital use or the host 11 for analog use to the display apparatus 100 by the DVI-D to DVI-D cable 14 or the D-Sub to DVI-I conversion cable 15, and the display apparatus 100 automatically distinguishes the type of cable, and can select either digital EDID or analog EDID according to the distinction made, and transmit this to the host 10 or the host 11. Then, the host 10 or the host 11 selects suitable software according to the received EDID, and carries out internal setting, so that a suitable video signal for digital or analog can be transmitted to the display apparatus 100, and the plug and play function can be realized.

Accordingly, it is no longer necessary for a user to carry out a setting operation on the display apparatus 100, as heretofore. Moreover, since switching of the multiplexer 21 is carried out before the host transmits a signal, the host can transmit a suitable video signal after receiving the EDID.

Furthermore, since it is configured without additional circuits for the video signal and synchronization signal, there is not any effect on the image quality.

Also, even if the D-Sub to DVI-I conversion cable 15 in which the HPD terminal is short circuited to the DDC 5V terminal, is used for other display apparatus, since the DDC 5V line is not disconnected or grounded, the plug and play function can be realized, and the generality of the cable can be improved.

Moreover, with old type hosts with a D-Sub interface, there are ones which do not output DDC 5V. However, with this embodiment, the power supply for the detection transistor 19 is taken from the DDC 5V terminal, and the diode 27 for electric current blocking is connected. Therefore, even in the case where the DDC 5V is not supplied, the collector voltage of the detection transistor 19 which switches the multiplexer 21, becomes an L level, and provided the monitor power supply 25 is supplied, the SCL and SDA lines can be switched to the analog EDID side.

Figure 2:
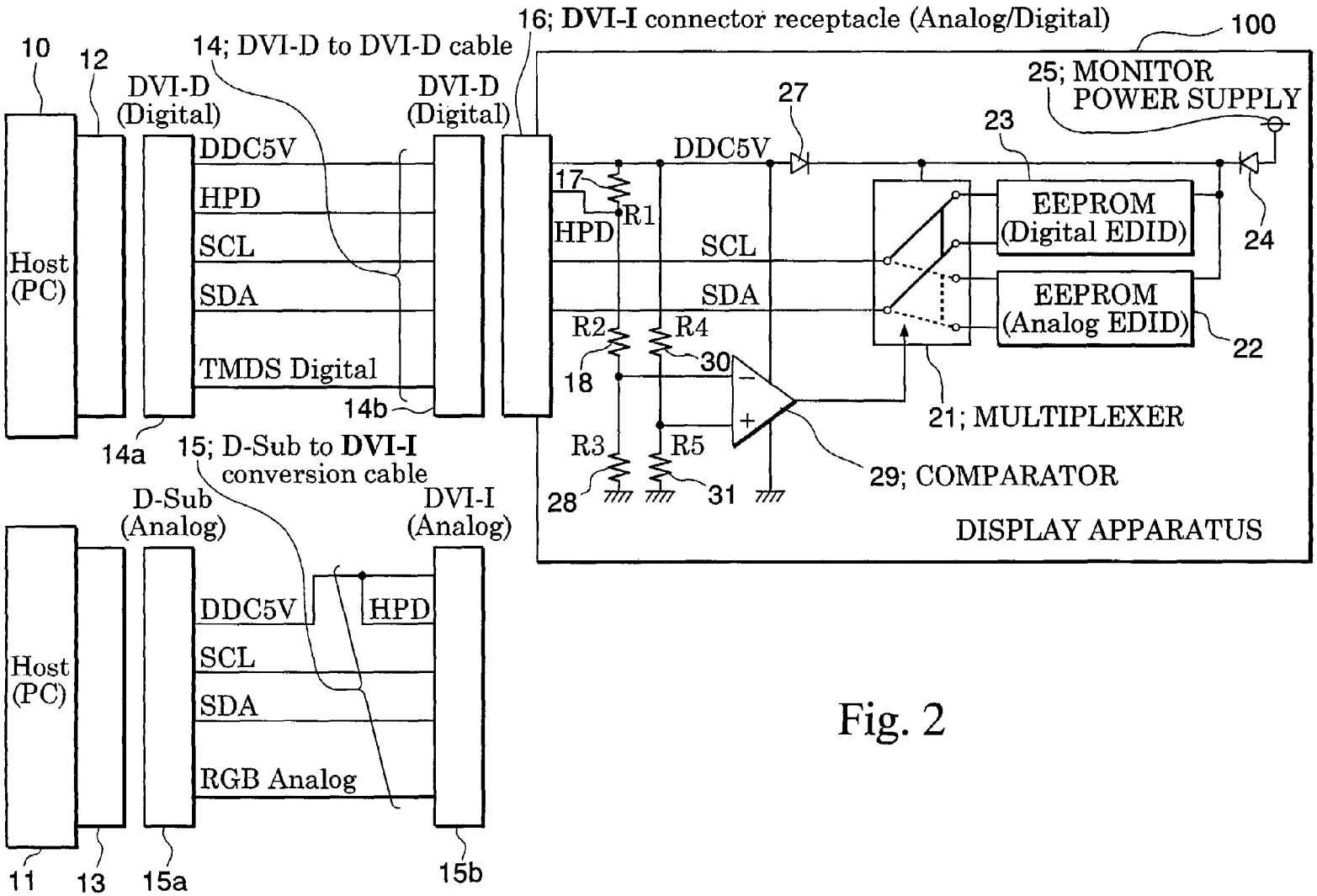
FIG. 2 is a block diagram showing a display system according to a second embodiment of the present invention.

FIG. 2 is a block diagram showing a display system according to a second embodiment of the present invention. Components corresponding to those in FIG. 1 are denoted by the same reference symbols and repeated description is omitted.

In FIG. 2, in this embodiment, a comparator 29 is provided as the distinguishing device instead of the detection transistor 19 in the display apparatus 100 of FIG. 1, and the output voltage of this comparator 29 serves as a switching signal to switch the multiplexer 21. The voltage of the DDC 5V divided by the resistors 30 and 31 (R4 and R5) is applied to the +terminal of the comparator 29, and the voltage divided by the resistors 17, 18 and 28 (R1, R2 and R3) is applied to the − terminal. Furthermore, the power supply voltage for the comparator 29 is obtained from the DDC 5V.

Next, the operation according to the aforementioned configuration is described.

In FIG. 2, when the DVI-D to DVI-D cable 14 is connected to the DVI-I receptacle 16 of the display apparatus 100, the output voltage of the comparator 29 becomes an H level, and the multiplexer 21 connects the SCL and SDA lines to the nonvolatile memory 23. Moreover, when the D-Sub to DVI-I conversion cable 15 is connected to the DVI-I receptacle 16 of the display apparatus 100, the output voltage of the comparator 29 becomes an L level, and the multiplexer 21 connects the SCL and SDA lines to the nonvolatile memory 22. The resistance values R1, R2, R3, R4, and R5 of the respective resistors 17, 18, 28, 30, and 31 are selected so that the output voltage of the comparator 29 changes as described above corresponding to the cable to be connected.

According to the present embodiment, by a user merely connecting the cable corresponding to the host used, the display apparatus 100 side can automatically select analog EDID or digital EDID and transmit this to the host, and the same effect as the first embodiment can be obtained.

Furthermore, since the output voltage of the comparator 29 is changed by applying the voltage divided by the resistors 17, 18, and 28 and the voltage divided by the resistors 30 and 31 to the − terminal and the + terminal of the comparator 29 respectively, the sum of resistance values of the resistors 17, 18 and 28 and the sum of resistance values of the resistors 30 and 31 can be increased respectively. Consequently, the consumption current can be reduced.

Moreover, since the voltage division ratio due to each resistor does not change even if the voltage of the DDC 5V fluctuates, a stable distinction result can be obtained.

Figure 3:
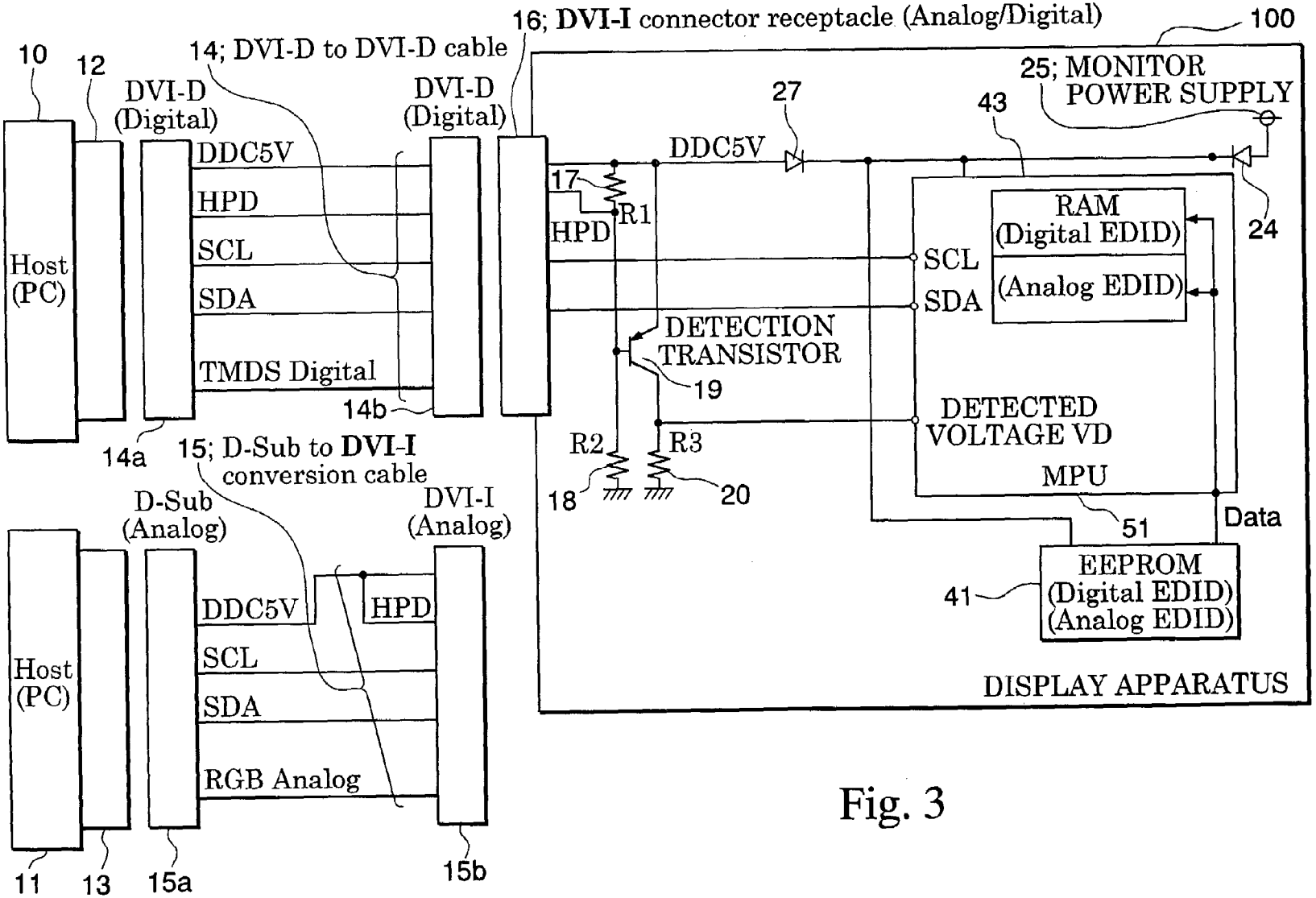
FIG. 3 is a block diagram showing a display system according to a third embodiment of the present invention.

FIG. 3 is a block diagram showing a display system according to a third embodiment of the present invention. Components corresponding to those in FIG. 1 are denoted by the same reference symbols and repeated description is omitted.

In FIG. 3, this embodiment is one where the two nonvolatile memories 22 and 23 of FIG. 1 are replaced by a large capacity nonvolatile memory 41, and an MPU 51 is provided. The MPU 51 is given the function of a multiplexer, and is provided with a RAM 43. The RAM 43 is made to temporarily store the contents of the nonvolatile memory 41. The power supply voltage for the MPU 51 is supplied from the DDC 5V or the monitor power supply 25.

Figure 4:
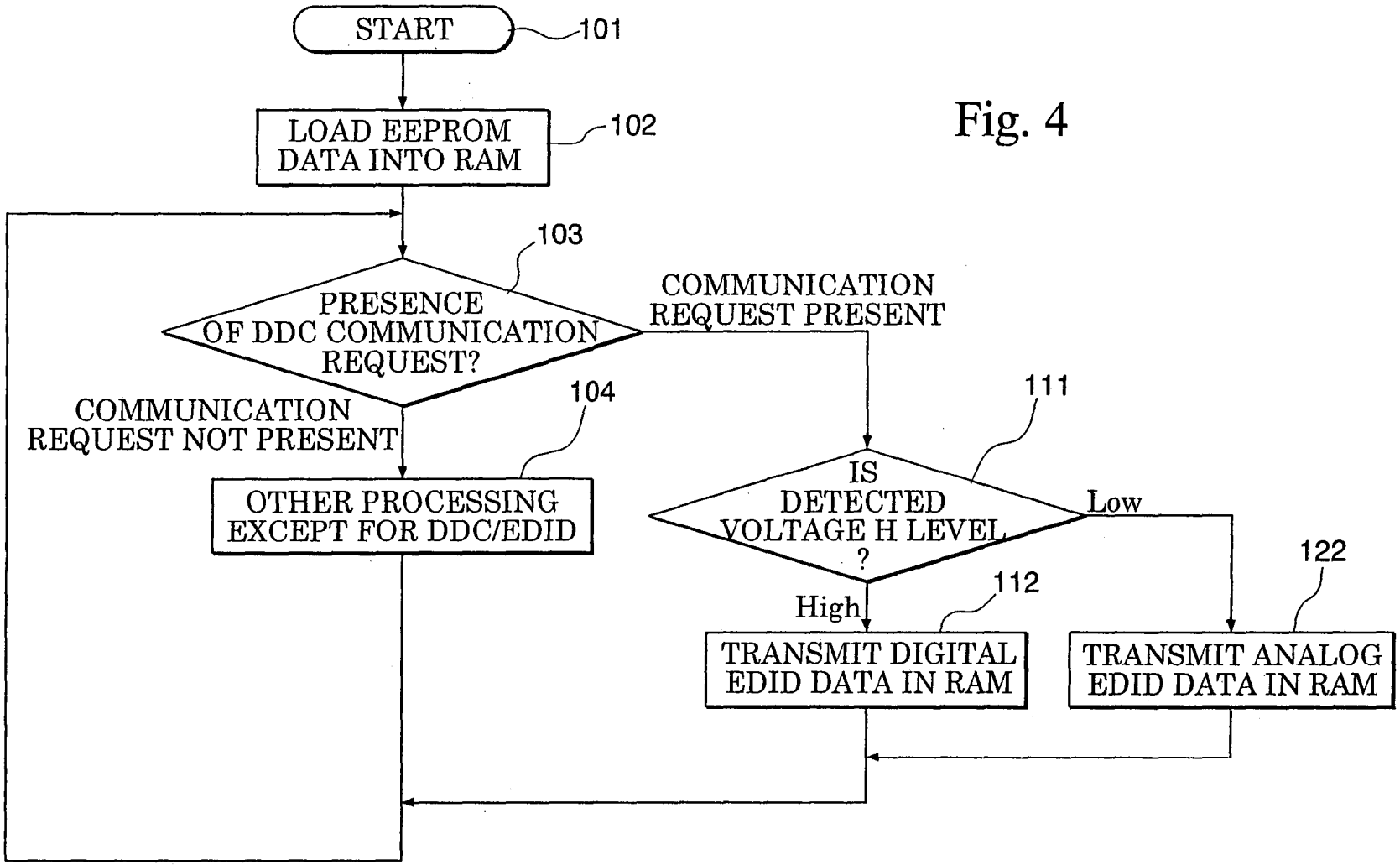
FIG. 4 is a flow chart showing the operation of the third embodiment.
Figure 5:
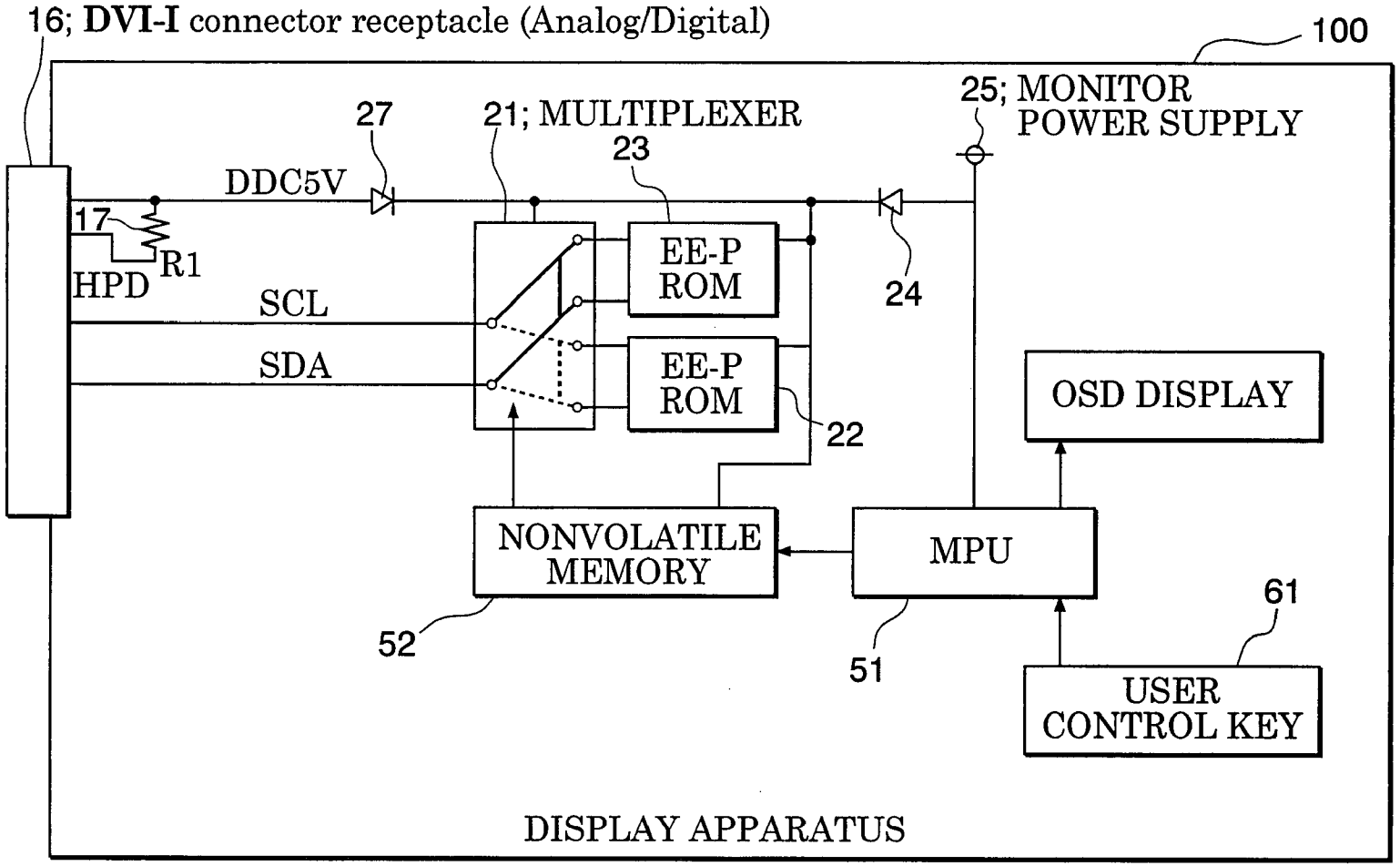
FIG. 5 is a block diagram showing a conventional display system.
Figure 6:
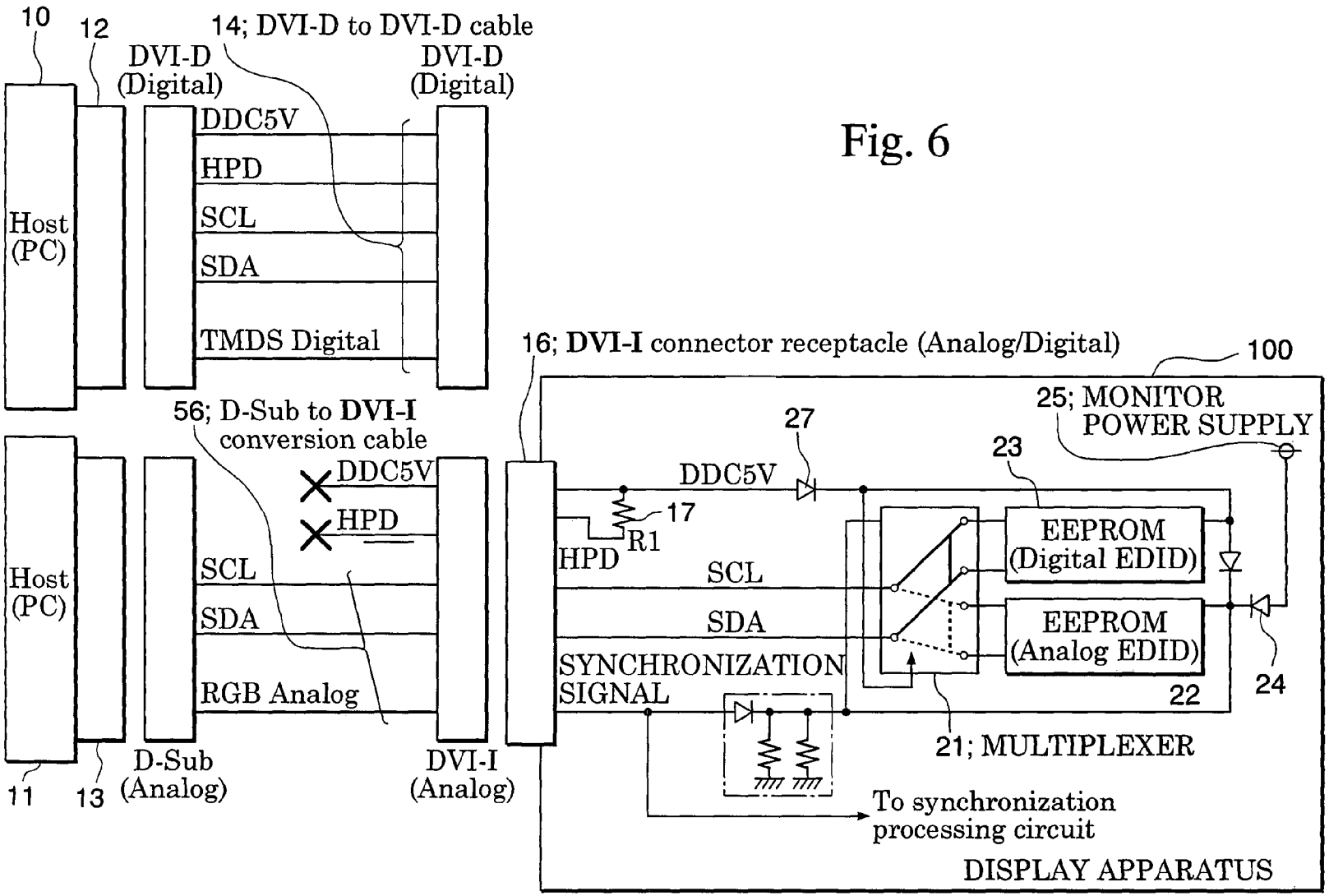
FIG. 6 is a block diagram showing another conventional display system.

Next, the operation of aforementioned configuration is described using the flow chart of FIG. 4. In FIG. 1 and FIG. 4, when the DVI-D to DVI-D cable 14 or the D-Sub to DVI-I conversion cable 15 is connected to the DVI-I receptacle 16 of the display apparatus 100, processing commences (step 101). Next, the analog EDID and the digital EDID stored in the nonvolatile memory 41 are loaded into the RAM 43 (step 102). Then, the presence of a DDC communication request from the host 10 or the host 11 is determined (step 103) and if there is no request, processing apart from the DDC/EDID processing is executed (step 104).

Next, it is determined whether the collector voltage of the detection transistor 19 is H level or not (step 111). If an H level, the digital EDID in the RAM 43 is transmitted through the SCL and SDA lines to the host 11 (step 112). If an L level, the analog EDID in the RAM 43 is transmitted through the SCL and SDA lines to the host 10 (step 122).

According to the present embodiment, by a user merely connecting a cable, the analog EDID or the digital EDID can be selected and transmitted to the host, and the same effect as the first embodiment can be obtained.

Furthermore, since the two nonvolatile memories 22 and 23 in FIG. 1 are replaced by a single large capacity nonvolatile memory 41, and the multiplexer function is given to the MPU 51, the number of parts can be reduced, enabling a low cost configuration.

What is claimed is:

1. A display apparatus comprising:

a storage device that stores a plurality of specification information for the display apparatus;

a connection device capable of selectively connecting a plurality of types of cable, and which has a first terminal for connection to a power supply terminal of said cable and a second terminal for connection to a power supply detection terminal of said cable;

a resistor connected between said first and second terminals;

a distinguishing device which distinguishes the type of the cable connected to said connection device by detecting a potential difference due to said resistor;

a selection device that selects one of said specification information from said storage device based on the distinction result of said distinguishing device; and a transmission device that transmits the specification information selected by said selection device via said connection device and cable to a computer.

2. A display apparatus according to claim 1, wherein the plurality of specification information stored by said storage device is digital interface type specification information and analog interface type specification information.

3. A display apparatus according to claim 2, wherein said plurality of types of cable are: a first cable having a power supply line from said computer, a power supply detection line, a transmission line for said specification information, and a transmission line for digital video signals from said computer; and a second cable having a power supply line from said computer, a transmission line for said specification information, and a transmission line for analog video signals from said computer, and with said power supply line and said second terminal of said connection device short circuited.

4. A display apparatus according to claim 3, wherein said specification information is EDID for a plug and play function, and said first cable is a DVI-D to DVI-D cable whose HPD terminal and DDC 5V line are not short circuited, and said second cable is a D-Sub to DVI-I conversion cable whose HPD terminal and DDC 5V line are short circuited, and a resistor is connected between the HPD terminal and the DDC 5V terminal of said connection device, and said distinguishing device detects the potential difference across both ends of said resistor and controls said selection device based on the detection result.

5. A display apparatus according to claim 4, wherein said distinguishing device is supplied with power from said DDC 5V, and said transmission device and said storage device are supplied with power from said DDC 5V via a first diode, or from an internal power source via a second diode.

6. A display apparatus according to claim 5, wherein said selection device is a multiplexer.

7. A display apparatus according to claim 1, wherein said plurality of types of cable are: a first cable having a power supply line from said computer, a power supply detection line, a transmission line for said specification information, and a transmission line for digital video signals from said computer; and a second cable having a power supply line from said computer, a transmission line for said specification information, and a transmission line for analog video signals from said computer, and with said power supply line and said second terminal of said connection device short circuited.

8. A display apparatus according to claim 7, wherein said specification information is EDID for a plug and play function, and said first cable is a DVI-D to DVI-D cable whose HPD terminal and DDC 5V line are not short circuited, and said second cable is a D-Sub to DVI-I conversion cable whose HPD terminal and DDC 5V line are short circuited, and a resistor is connected between the HPD terminal and the DDC 5V terminal of said connection device, and said distinguishing device detects the potential difference across both ends of said resistor and controls said selection device based on the detection result.

9. A display apparatus according to claim 8, wherein said distinguishing device is supplied with power from said DDC 5V, and said transmission device and said storage device are supplied with power from said DDC 5V via a first diode, or from an internal power source via a second diode.

10. A display apparatus according to claim 1, wherein said selection device is a multiplexer.

11. A display system comprising:

a display apparatus provided with:

a storage device that stores a plurality of specification information for the display apparatus;

a connection device capable of selectively connecting a plurality of types of cable, and which has a first terminal for connection to a power supply terminal of said cable and a second terminal for connection to a power supply detection terminal of said cable;

a resistor connected between said first and second terminals;

a distinguishing device which distinguishes the type of the cable connected to said connection device by detecting a potential difference due to said resistor;

a selection device that selects one of said specification information from said storage device based on the distinction result of said distinguishing device; and a transmission device that transmits the specification information selected by said selection device via said connection device and cable to a computer;

one of said plurality of types of cable for connection to said connection device; and a computer provided with: a connection device for connection to said display apparatus via said cable; and a transmission device which transmits a video signal to said display apparatus based on said specification information sent from said display apparatus.

12. A display apparatus according to claim 11, wherein said plurality of types of cable are: a first cable having a power supply line from said computer, a power supply detection line, a transmission line for said specification information, and a transmission line for digital video signals from said computer; and a second cable having a power supply line from said computer, a transmission line for said specification information, and a transmission line for analog video signals from said computer, and with said power supply line and said second terminal of said connection device short circuited.

* * * * *